United States Patent [19]

Halmosi et al.

[11] 4,246,972

[45] Jan. 27, 1981

[54] MOTOR GRADER AND POSITIONING MECHANISM FOR DRAWBAR THEREOF

[75] Inventors: Rudolph Halmosi, Hudson; Karl W. Schneider, Parma, both of Ohio

[73] Assignee: General Motors Corporation, Detroit, Mich.

[21] Appl. No.: 49,566

[22] Filed: Jun. 18, 1979

[51] Int. Cl.[2] ..... E02F 3/76

[52] U.S. Cl. ..... 172/789; 172/793

[58] Field of Search ..... 172/781, 789, 791, 792, 172/793, 795, 796, 797

[56] References Cited

U.S. PATENT DOCUMENTS

| | | | |
|---|---|---|---|
| 2,655,743 | 10/1953 | Ross | 172/793 |
| 3,038,268 | 6/1962 | Vivier | 172/793 |
| 3,454,110 | 7/1969 | Hanser | 172/793 |
| 3,739,861 | 6/1973 | Johnson et al. | 172/793 |
| 3,986,563 | 10/1976 | Stubben | 172/793 |
| 4,108,251 | 8/1978 | Rathje et al. | 172/789 |

FOREIGN PATENT DOCUMENTS

| | | | |
|---|---|---|---|
| 1269062 | 5/1968 | Fed. Rep. of Germany | 172/791 |
| 1484689 | 4/1969 | Fed. Rep. of Germany | 172/789 |
| 180707 | 9/1962 | Sweden | 172/793 |

*Primary Examiner*—Richard T. Stouffer
*Attorney, Agent, or Firm*—Edward J. Biskup

[57] ABSTRACT

A blade positioning mechanism for a motor grader that permits the blade ends to be raised or lowered independently of each other or together through a pair of hydraulic cylinders universally gimballed in independent locking bell cranks. The mechanism also allows the blade to be shifted to either side of the vehicle and into a substantially vertical position.

2 Claims, 4 Drawing Figures

MOTOR GRADER AND POSITIONING MECHANISM FOR DRAWBAR THEREOF

This invention relates to motor graders and more particularly to a positioning mechanism for the blade drawbar of a motor grader.

More specifically, the invention concerns a motor grader having a main frame provided with a drawbar which has a front end and a rear end. The front end of the drawbar is mounted to the main frame of the grader through a universal connection, while the rear end of the drawbar is fixed with a cross-beam which includes a blade. A blade positioning mechanism is mounted on the main frame and serves to support the cross-beam of the drawbar so as to permit the blade ends to be raised or lowered independently of each other or together and also allows the blade to be shifted to either side of the motor grader into a substantially vertical position. The blade positioning mechanism comprises a pair of bell cranks that are pivotally mounted to the frame above the rear end of the drawbar for movement about laterally spaced first and second pivot axes which extend longitudinally of the main frame. One of the bell cranks is Y-shaped and the other is V-shaped and a pair of double-acting lift jacks have their cylinder portion respectively connected to the bell cranks for pivotal movement about longitudinal and transverse axes. The piston rods of the respective lift jacks are pivotally connected to the cross-beam at laterally spaced points. A U-shaped support is rigidly connected to the main frame below the first and second pivot axes and extends transversely to the longitudinal axis of the main frame. The U-shaped support is provided with a pair of arms which extend laterally outwardly in opposite directions from the main frame and terminate at points located in a horizontal plane above the first and second pivot axes. In addition, each of the bell cranks is provided with a longitudinally shiftable locking pin which cooperates with a plurality of holes formed in the arms of the U-shaped support for allowing adjustment of the position of the bell cranks and, accordingly, the blade relative to the main frame of the motor grader.

The objects of the present invention are to provide a new and improved positioning mechanism for the blade support member of a motor grader; to provide a new and improved control linkage combined with a U-shaped support connected with the main frame of a motor grader that allows the blade drawbar to be shifted sideways to different positions; to provide a new and improved positioning mechanism for a blade circle of a motor grader that permits the blade ends to be raised or lowered independently of each other or together and allows the blade to be shifted to either side and into a substantially vertical position; and to provide a new and improved positioning linkage for the drawbar of a motor grader that is hydraulically powered and facilitates sideways adjustment of the drawbar to different positions.

Other objects and advantages will be apparent from the following detailed description when taken with the drawings in which:

FIG. 4 is an enlarged sectional view taken on line 4—4 of FIG. 2 showing in detail the construction of one of the lock pin assemblies.

Figures 1, 2:
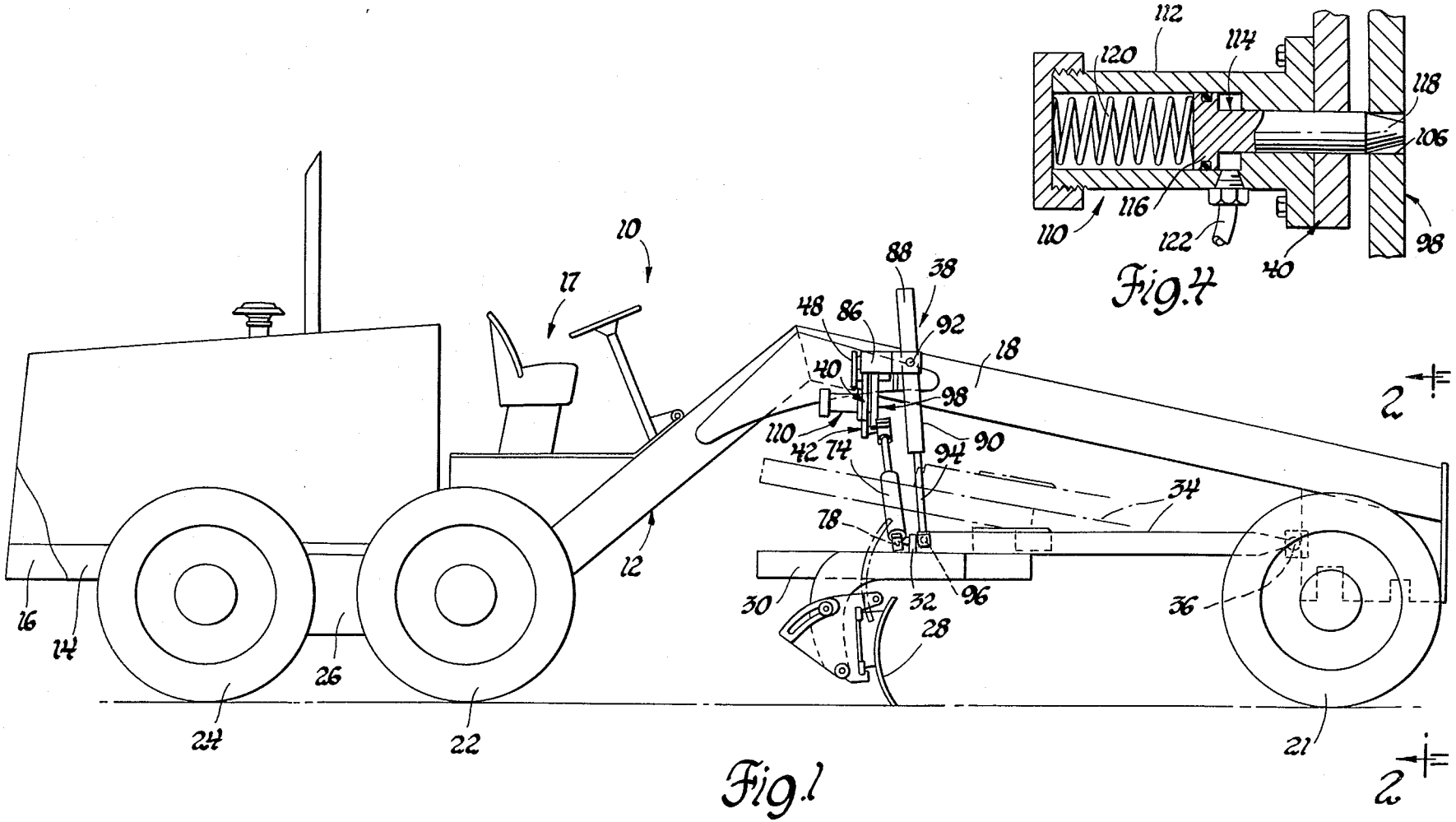
FIG. 1 is an elevational view showing a motor grader incorporating a blade positioning mechanism made in accordance with the invention.
FIG. 2 is a front elevational view of the blade positioning mechanism taken on line 2—2 of FIG. 1.
Figure 2:
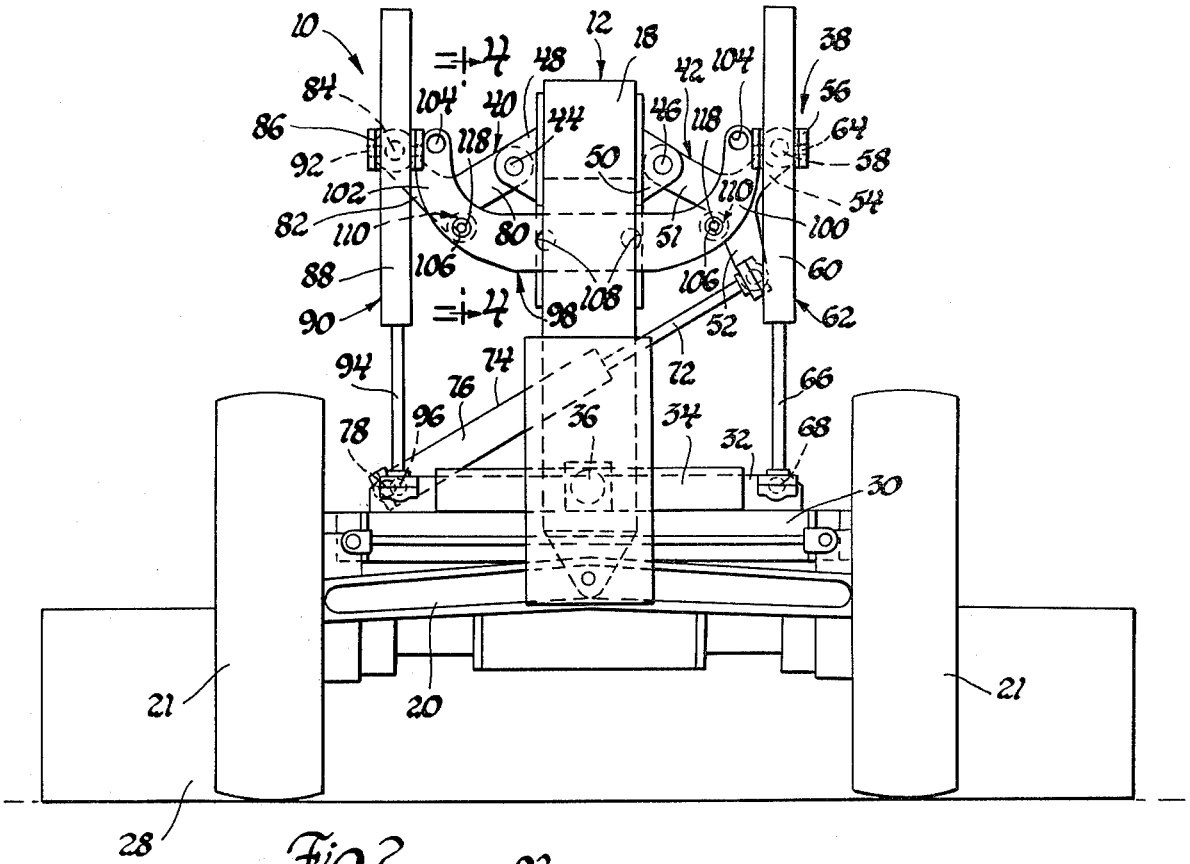

Referring to the drawings and more particularly FIG. 1 thereof, a motor grader 10 is shown comprising a main frame 12 which consists of two cross-braced longitudinally extending members 14 and 16 which support the engine (not shown) and converge forwardly of an operator's station 17 to form a single arched beam 18 terminating with a front axle 20 that rotatably carries laterally spaced steerable wheels 21. The engine provides drive to tandem drive wheels 22, 24 rotatably mounted on a drive case 26, which in turn, is pivoted at its mid point to an inner transversely extending axle (not shown) so that the drive wheels 22, 24 can follow irregularities in the ground without losing contact. As is conventional, the motor grader 10 is provided with a transversely extending blade 28 which is attached to a blade circle 30 which, in turn, is carried by a cross-beam 32 fastened to the rear end of a V-shaped drawbar 34. The front end or apex of the drawbar 34 is fastened to the front end of the main frame 12 by a ball and socket joint 36, while the cross-beam 32 of the drawbar 34 is suspended by a blade positioning mechanism 38 made in accordance with the invention.

As seen in FIG. 2, the blade positioning mechanism 38 comprises a V-shaped bell crank 40 and a Y-shaped bell crank 42 which are respectively connected by pivot connections 44 and 46 to laterally spaced brackets 48 and 50 fixed with the arched beam 18 of the motor grader 10. The respective pivotal connections 44 and 46 allow the bell cranks 40 and 42 to rotate about longitudinally extending and laterally spaced pivot axes located on opposite sides of the arched beam 18.

The bell crank 42 is formed with three arms 51, 52 and 54 with arm 54 being pivotally connected to a U-shaped bracket 56 by a longitudinally extending pivot connection 58. As seen in FIG. 2, the bracket 56, in turn, is pivotally connected to the cylinder portion 60 of a double-acting hydraulic lift jack 62 by a transversely extending pivot connection 64 so that together with the pivot connection 58, the cylinder portion 60 is universally pivotally supported by the bracket 56. Also, the cylinder portion 60 of the lift jack 62 houses the usual relative reciprocable piston member, the rod portion 66 of which is connected by a ball and socket joint 68 to one end of the cross-beam 32. Finally, it will be noted that the arm 52 of the bell crank 42 is connected through a ball and socket connection 70 to the rod portion 72 of a double-acting hydraulic cylinder 74, the cylinder portion 76 of which is connected by a ball and socket connection 78 to the other end of the cross-beam 32.

The bell crank 40 is formed with two arms 80 and 82 the latter of which extends outwardly and is connected by a longitudinally extending pivotal connection 84 to a U-shaped bracket 86 which is identical to the aforementioned bracket 56. As seen in FIG. 1, the bracket 86, in turn, is pivotally connected to the cylinder portion 88 of a double-acting hydraulic lift jack 90 by a transversely extending pivot connection 92. Thus, as in the case of the lift jack 62, the cylinder portion 88 of lift jack 90 is universally pivotally carried by the associated bracket 86. The piston rod portion 94 of the lift jack 90 is connected by a ball and socket joint 96 to the cross-beam adjacent to and forwardly of the ball and socket connection 78 provided for the hydraulic cylinder 74.

Located forwardly of the bell cranks 40 and 42 is a U-shaped support member 98 which is rigid with the lower portion of the arched beam 18 of the main frame. The support member 98 is rigidly connected to the arched beam 18 below the pivot connection 44 and 46 and is formed with a pair of identical arms 100 and 102 which extend laterally outwardly in opposite directions and terminate at points located in a horizontal plane located above the pivotal connections 44 and 46. Each of the arms 100, 102 of the support member 98 is provided with three identical holes 104, 106 and 108 the center of each of which is located on an arc of a circle having its center at the support pivot for the adjacent bell crank. Thus, the holes 104, 106 and 108 formed in the arm 100 are located on an arc of a circle having the center of the pivotal connection 46 as its center. Similarly, the holes 104, 106 and 108 formed in the arm 102 are located on an arc of a circle having the center of the pivotal connection 44 as its center.

As seen in FIGS. 1 and 4, each of the bell cranks, 40 and 42, is provided with a lock pin assembly 110 consisting of a cylinder housing 112 which is secured to the associated bell crank and slidably supports a locking pin 114, one end of which is formed with a piston head 116. The locking pin 114 terminates with a tapered end 118 that is adapted to register with one of three complementary holes 104, 106 and 108 formed in the associated arm of the support member 98. The locking pin 114 is normally urged outwardly from the housing 112 by a spring 120 located in the rear portion of the housing. The locking pin 114 is adapted to be retracted into the housing 112, and thereby removed from the accommodating hole in the support member 98, when pressurized fluid is directed through a conduit 122 leading to one side of the piston head 116.

As seen in FIGS. 1 and 2, the locking pin 114 carried by each bell crank 40 and 42 is in the extended position and is located within the hole 106 formed in the associated arm of the support member 98 so as to lock the bell cranks in the positions shown and thereby maintain the cross-beam as well as the blade in a fixed horizontal position relative to the main frame 12 of the motor grader 10. When pressurized fluid is directed through conduit 122 to the one side of the piston head 116, the locking pin 114 is urged inwardly against the bias of the spring 120 so as to retract the locking pin 114 from locking engagement with the support member 98. As a result, the associated bell crank is free to rotate about its pivotal connection with the arched beam to a position wherein the lock pin is aligned with either the hole 104 or the hole 108.

Figure 3:
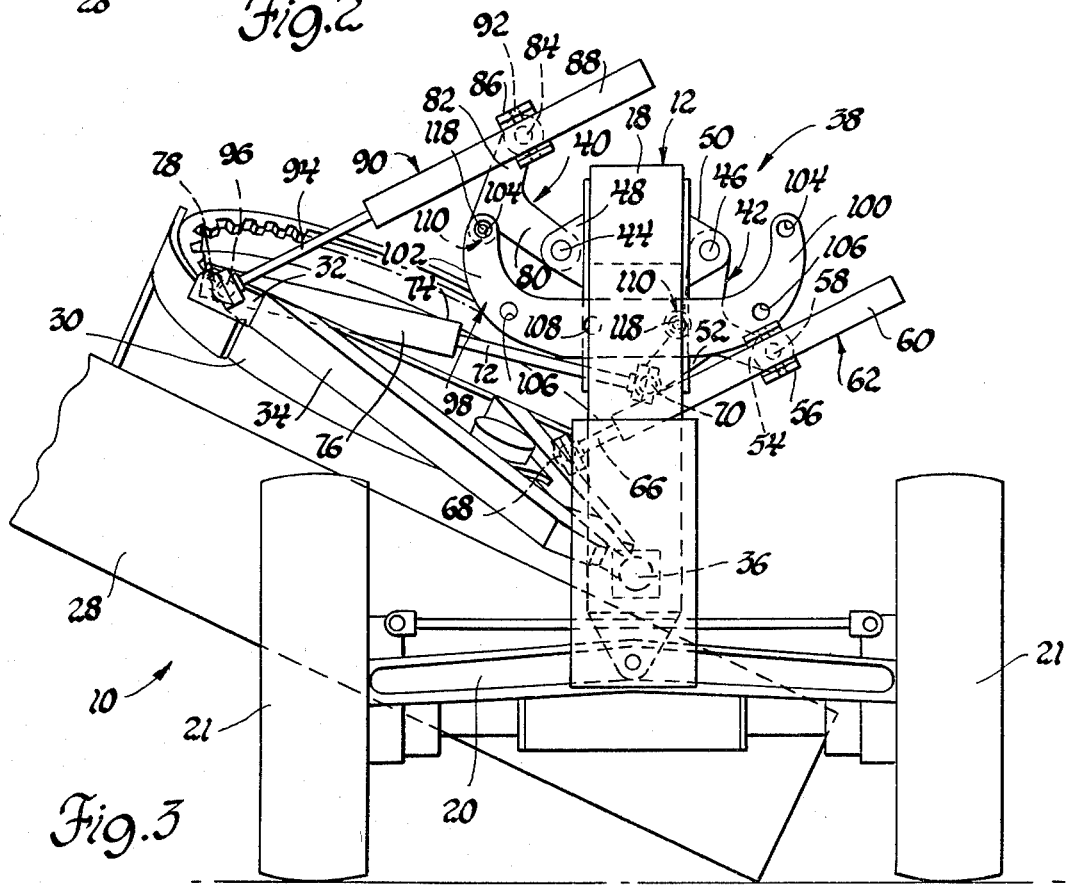
FIG. 3 is a view similar to FIG. 2 but shows the blade shifted to the right by the blade positioning mechanism as viewed by the operator.

Each bell crank, 40 and 42, can be independently adjusted for realizing a repositioning of the blade 28. For example, if the vehicle operator wishes to shift the blade 28 to the position shown in FIG. 3, initially the lift jacks 62 and 90 would be extended so as to lower the blade 28 into contact with the ground as shown in FIG. 2. The locking pin 114 associated with the bell crank 40 can then be retracted so as to release the bell crank 40 from locking engagement with the arm 102 of the support 98. The lift jack 90 is then expanded causing the bell crank 40, as seen in FIG. 2, to rotate in a clockwise direction to the position of FIG. 3. When the locking pin 114 of the bell crank 40 is aligned with the hole 104 formed in the arm 102, the conduit 122 leading to the housing 112 of the locking pin assembly 110 is connected to reservoir or vented so as to cause the spring 120 to urge the locking pin 114 towards the extended position and into the hole 104. Afterwards, the locking pin 114 associated with the bell crank 42 is retracted so as to release the bell crank 42 from locked engagement with the arm 100. The lift jack 62 and the hydraulic cylinder 74 are simultaneously contracted causing the bell crank 42 to rotate clockwise about the pivot connection 46 to the position shown in FIG. 3. During such time, some movement of the blade 28 towards the left as seen in FIGS. 2 and 3 will occur. When the locking pin is aligned with the hole 108 in the arm 100, the spring 120 is allowed to return the locking pin to the extended position into the hole 108. Subsequently, the lift jack 90 is contracted and the hydraulic cylinder 72 is expanded to the lengths shown in FIG. 3 resulting in the blade 28 assuming the position shown.

As should be apparent from the above, the position of the blade 28 can be varied by operation of the lift jacks 62 and 90 and the hydraulic cylinder 74. Moreover, the blade 28 can assume a substantially vertical position to one side of the arched beam or the other when desired by proper actuation of the lift jacks. For example, as seen in FIG. 3, a full contraction of the lift jack 90 will cause the blade 28 to move to a substantially vertical position. Also, as seen in FIG. 2, if it is desired to tilt and translate the blade 28 towards the right side of the main frame 12, the locking pins 114 associated with both of the bell cranks 40 and 42 would be retracted and, afterwards, the bell cranks 40 and 42 would be rotated in a counterclockwise direction about their respective pivot connections with the frame until the locking pin 114 associated with bell crank 42 registers with the hole 104 and the locking pin associated with the bell crank 40 registers with the hole 108. In addition, the right end of the blade 28, as seen in FIG. 2, can be raised by contracting the lift jack 62 or if it is desired to raise both ends of the blade, both lift jacks can be contracted so that the blade assumes the raised position shown in phantom lines in FIG. 1. It should be noted that the operations consisting of actuating the lift cylinders 60 and 90 or the rotating of the bell cranks 40 and 42 relative to the the support frame as described above by operating the lift cylinders and retracting the locking pin 114, may be performed simultaneously or independently. As a result, a great amount of flexibility is provided for positioning the blade 28 to the position desired by the motor grader operator. It will also be noted that the hydraulic cylinder 74 also serves as an added adjusting strut to the positioning mechanism. Accordingly, various positioning of the blade 28 can be realized through operation of the lift jacks as well as the hydraulic cylinder.

Various changes and modifications can be made in this construction without departing from the spirit of the invention. Such changes and modifications are contemplated by the inventors and they do not wish to be limited except by the scope of the appended claims.

The embodiments of the invention in which an exclusive property or privilege is claimed are defined as follows:

1. In a motor grader having a main frame, a drawbar having a front end and a rear end, a universal connection mounting the front end of the drawbar to said main frame, a cross-beam including a blade secured to the rear end of the draw bar, a blade positioning mechanism carried by said main frame and connected to said cross-beam, said positioning mechanism comprising a pair of bell cranks pivotally mounted to said frame above the rear end of the drawbar for movement about laterally spaced first and second pivot axes which extend longitudinally of the main frame, a pair of double-acting lift jacks, each of said lift jacks having relatively movable piston and cylinder members, means connecting the cylinder members of the lift jacks to one arm of each of the bell cranks for pivotal movement about longitudinal and transverse axes, means pivotally connecting the piston members of the lift jacks to laterally spaced points of the cross-beam, a U-shaped support rigidly connected to said main frame below said first and second pivot axes and extending transversely to the longitudinal axis of the main frame, said U-shaped support having the arms thereof extending laterally outwardly from said main frame in opposite directions and terminating at an elevation above said first and second pivot axes, lock pin means carried by each of said bell cranks, and a plurality of holes formed in said arms of said U-shaped support for receiving the lock pins associated with said bell cranks and thereby providing adjustment of the position of the blade relative to the main frame.

2. In a motor grader having a main frame, a drawbar having a front end and a rear end, a universal connection mounting the front end of the drawbar to said main frame, a cross-beam including a blade secured to the rear end of the drawbar, a blade positioning mechanism carried by said main frame and connected to said cross-beam, said positioning mechanism comprising a pair of bell cranks pivotally mounted to said frame above the rear end of the draw bar for movement about laterally spaced first and second pivot axes which extend longitudinally of the main frame, one of said bell cranks being Y-shaped and the other being V-shaped, a pair of double-acting lift jacks, each of said lift jacks having relatively movable piston and cylinder members, means connecting the cylinder members of the lift jacks to one arm of each of the bell cranks for pivotal movement about longitudinal and transverse axes, means pivotally connecting the piston members of the lift jacks to laterally spaced points of the cross-beam, a U-shaped support rigidly connected to said main frame below said first and second pivot axes and extending transversely to the longitudinal axis of the main frame, said U-shaped support having a pair of arms extending laterally outwardly from said main frame in opposite directions and terminating at points located in a horizontal plane above said first and second pivot axes, lock pin means carried by each of said bell cranks, and at least two holes formed in each of said arms of said U-shaped support, the centers of said holes on each of said arms of said U-shaped support being located on an arc of a circle whereby the associated bell crank can be independently rotated about its pivot axis with the main frame and permit the lock pin means to selectively register with one of said holes and thereby facilitate adjustment of the position of the blade relative to the main frame.

* * * * *